US006071176A

United States Patent [19]

Kruis

[11] Patent Number: 6,071,176

[45] Date of Patent: Jun. 6, 2000

[54] GAUGE FOR AND METHOD OF CALIBRATING A LENS CUTTING/ GRINDING MACHINE

[75] Inventor: Fritz R. Kruis, Tulsa, Okla.

[73] Assignee: Gerber Coburn Optical, Inc., South Windsor, Conn.

[21] Appl. No.: 09/182,136

[22] Filed: Oct. 29, 1998

[51] Int. Cl.[7] ..... B24B 49/00

[52] U.S. Cl. ..... 451/5; 451/42; 33/28

[58] Field of Search ..... 451/5, 25, 41, 451/42, 17, 22; 73/865.9; 33/28, 507, 200

[56] References Cited

U.S. PATENT DOCUMENTS

| | | | |
|---|---|---|---|
| 4,656,754 | 4/1987 | Cingone | 33/507 |
| 5,177,907 | 1/1993 | Rothe et al. | 451/42 |
| 5,520,568 | 5/1996 | Craighead et al. | 451/42 |
| 5,960,550 | 10/1999 | Weir et al. | 33/28 |
| 5,964,040 | 10/1999 | Keen et al. | 33/28 |

*Primary Examiner*—Robert A. Rose
*Assistant Examiner*—G Nguyen
*Attorney, Agent, or Firm*—Frank J. Catalano

[57] ABSTRACT

A calibration gauge for use in calibrating a lens cutting/ grinding machine has a disk with a concentric post on one of its faces for chucking the disk to a lens spindle. A target delineated on the other face of the disk consists of bands aligned on the X and Y axes and intersecting at the center of the disk. The width of the bands is not greater than the acceptable error in positioning of the X and Y axes. The calibrating operator sets a limit of Z-axis motion of the lens spindle corresponding to a selected depth of cutting/grinding a lens. The gauge is chucked to the lens spindle. The X-axis position of the tool is aligned by computer with the Z-axis. Rotation of the tool spindle is initiated and the lens spindle is raised to plunge cut/grind the gauge. The lens spindle is lowered and rotation of the tool spindle is terminated. The gauge is dechucked and the depth of the cut/grind is measured. The difference between the measured and selected depths is determined. The Z-axis calibration of the lens spindle is jockeyed by use of the computer to compensate for the difference. The operator also observes the quadrant position of the cut/grind center on the gauge to determine its displacement from center. The X-axis calibration of the tool is then jockeyed by use of the computer to compensate for X-axis displacement and the Y-axis calibration of the tool is manually adjusted to compensate for the Y-axis displacement.

9 Claims, 4 Drawing Sheets

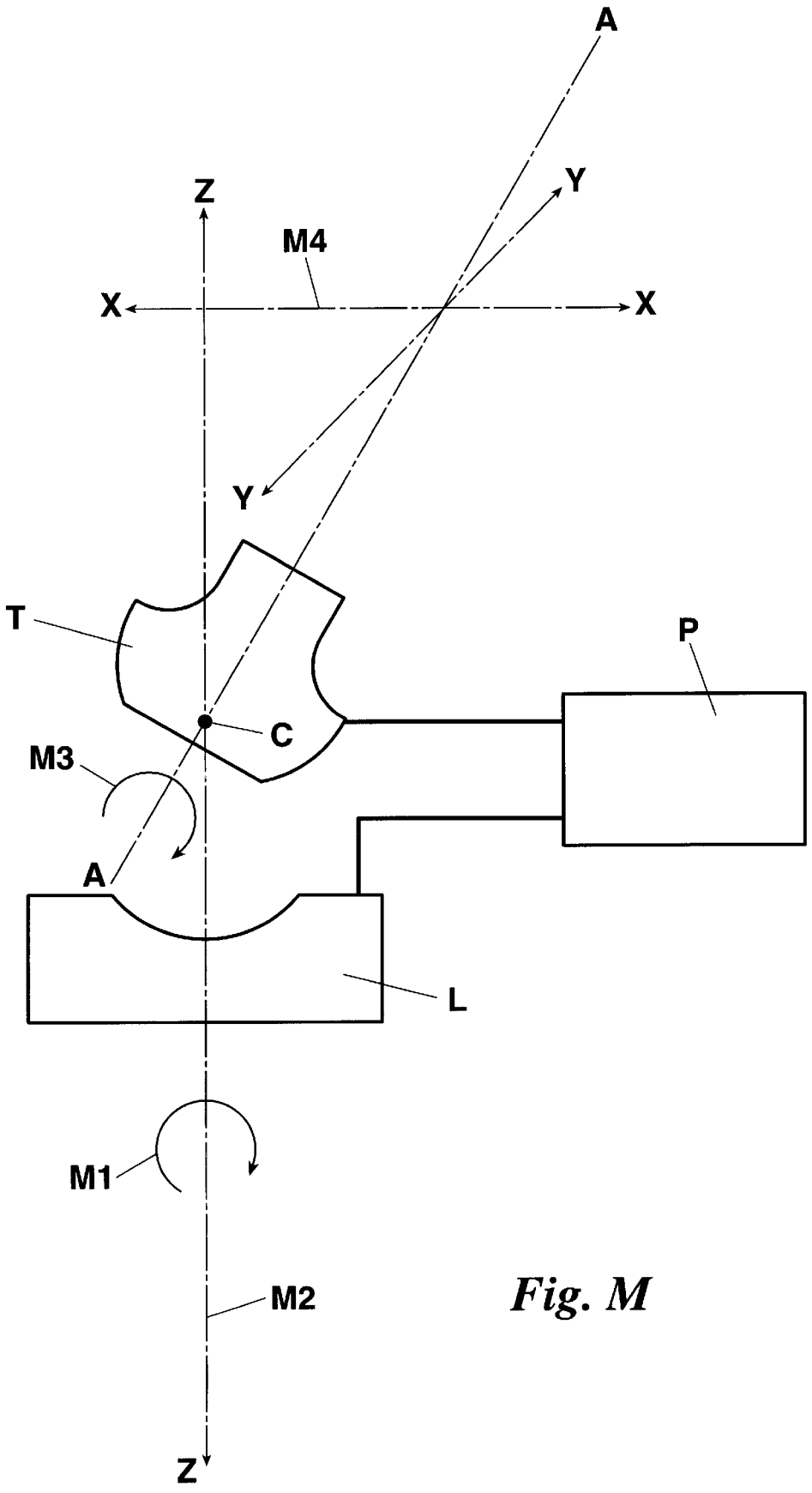
*Fig. M*

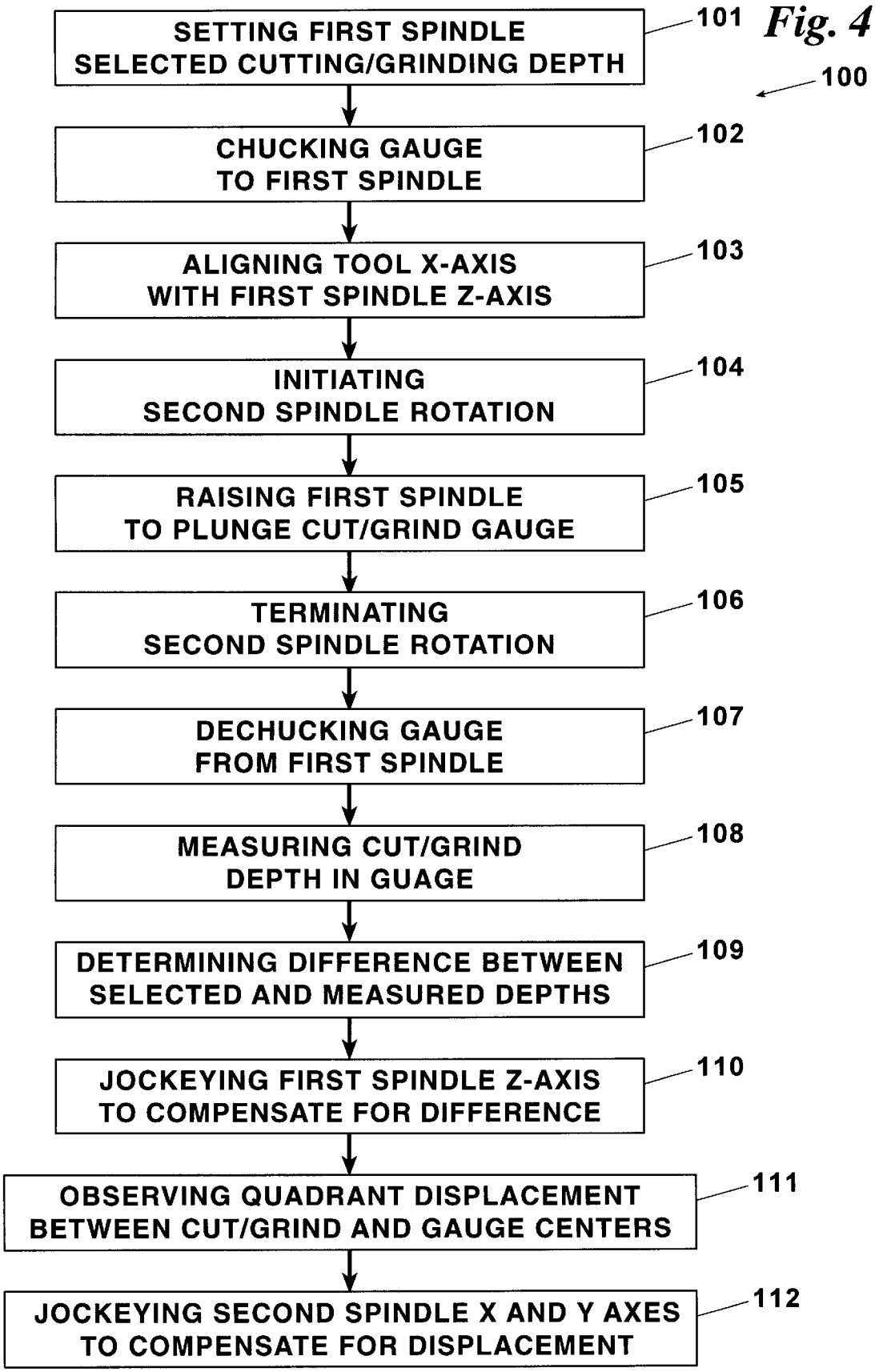
Fig. 4
100
SETTING FIRST SPINDLE SELECTED CUTTING/GRINDING DEPTH
101
CHUCKING GAUGE TO FIRST SPINDLE
102
ALIGNING TOOL X-AXIS WITH FIRST SPINDLE Z-AXIS
103
INITIATING SECOND SPINDLE ROTATION
104
RAISING FIRST SPINDLE TO PLUNGE CUT/GRIND GAUGE
105
TERMINATING SECOND SPINDLE ROTATION
106
DECHUCKING GAUGE FROM FIRST SPINDLE
107
MEASURING CUT/GRIND DEPTH IN GUAGE
108
DETERMINING DIFFERENCE BETWEEN SELECTED AND MEASURED DEPTHS
109
JOCKEYING FIRST SPINDLE Z-AXIS TO COMPENSATE FOR DIFFERENCE
110
OBSERVING QUADRANT DISPLACEMENT BETWEEN CUT/GRIND AND GAUGE CENTERS
111
JOCKEYING SECOND SPINDLE X AND Y AXES TO COMPENSATE FOR DISPLACEMENT
112

GAUGE FOR AND METHOD OF CALIBRATING A LENS CUTTING/GRINDING MACHINE

BACKGROUND OF THE INVENTION

This invention relates generally to the making of ophthalmic lenses and more particularly concerns calibration of machines used to cut/grind ophthalmic lens blanks.

A recent design of a machine for cutting/grinding ophthalmic lenses described in detail in a copending U.S. patent application is illustrated in FIG. M. The machine cuts/grinds an ophthalmic lens L which is chucked to the upper end of a first spindle which is in turn aligned on a Z-axis. One motor M1 rotates the lens spindle and the chucked lens blank L about the Z axis while another motor M2 reciprocates the lens spindle and the chucked lens blank L along the Z axis. A cutting/grinding tool T is mounted on the lower end of second spindle which is aligned on an axis A angled, preferably obtusely, with respect to the Z-axis. A third motor M3 rotates the tool spindle and the tool T about the angled axis A while a fourth motor M4 reciprocates the tool spindle and the tool T along an X-axis. A microprocessor P coordinates the rotation of the spindles about the Z and A axes and the reciprocation of the spindles on the Z and X axes to cause the tool T to cut/grind the lens blank L in accordance with its predetermined contour. Manual adjustment of the alignment of the tool T on a Y-axis perpendicular to the X and Z axes is possible.

Among the purposes of this machine are the minimization of calibration and tuning of the machine, accomplished in part because the lens thickness is a function of vertical lens movement only and in part because the operation of the machine is controlled by a single microprocessor.

While the machine described achieves this purpose very well in comparison to previously known machines, calibration is still an iterative process. Thus, while the number of parameters to be iteratively adjusted have been minimized by the machine, it is further desirable to minimize the number of iterations required for each parameter.

It is, therefore, an object of this invention to provide a gauge and method which provides Cartesian information suitable for calibration of a lens cutting/grinding machine. Another object of this invention is to provide a gauge and method which afford complete Cartesian calibration information as a result of a single operation of the machine.

SUMMARY OF THE INVENTION

In accordance with the invention, a calibration gauge is provided for use in calibrating a lens cutting/grinding machine. The gauge consists of a disk of material which is cuttable/grindable by the tool and which has a concentric post on one of its faces for chucking the disk to the first spindle. A pair of prong holes in the post is aligned along a diameter of the post and cooperates with complementary prongs on the machine chuck to maintain the disk in one of two 180 degree displaced orientations in relation to the X and Y axes. Preferably, the prong holes are symmetrically displaced from the center of the post.

A target on an opposite face of the disk from the post consists of bands which are delineated on the disk. The bands are aligned by the prongs on the X and Y axes and intersect at the center of the disk on the Z-axis. The bands define four quadrants on the face of the disk. Preferably, the prong locating diameter is centered on one of the bands. The width of the bands is determined as the acceptable error in positioning of the X and Y axes without need for adjusting the machine.

The method of using the gauge to calibrate the machine involves several steps. The calibrating operator first sets a limit of Z-axis motion of the first spindle which corresponds to a selected depth of cutting/grinding a lens. The disk-shaped calibration gauge with four quadrants delineated on its face by bands aligned on the X and Y axes as above described is then chucked to the first spindle with the center of the disk aligned on the Z-axis. The X-axis position of the tool is aligned with the Z-axis. Rotation of the second spindle is then initiated and the first spindle is raised to plunge cut/grind the gauge to the selected depth. The first spindle is lowered to enable dechucking of the gauge and rotation of the second spindle is terminated. The gauge is dechucked and the depth of the cut-grind in the gauge is measured. The difference between the measured depth and the selected depth is determined. The Z-axis calibration of the first spindle is then jockeyed by use of the computer to compensate for the difference. The operator also observes the quadrant position of the cut/grind center on the gauge to determine its displacement from center. The X axis calibration of the tool is then jockeyed by use of the computer to compensate for X-axis displacement and the Y axis calibration of the tool is manually adjusted to compensate for the Y-axis displacement.

BRIEF DESCRIPTION OF THE DRAWINGS

Other objects and advantages of the invention will become apparent upon reading the following detailed description and upon reference to the drawings in which:

FIG. M is a one-line illustration of a machine to be calibrated using the present gauge and method;

FIG. 4 is a block diagram illustrating the preferred method of calibrating the machine according to the present invention;

While the invention will be described in connection with a preferred embodiment and method, it will be understood that it is not intended to limit the invention to that embodiment and method. On the contrary, it is intended to cover all alternatives, modifications and equivalents as may be included within the spirit and scope of the invention as defined by the appended claims.

DESCRIPTION OF THE INVENTION

Figure 3:
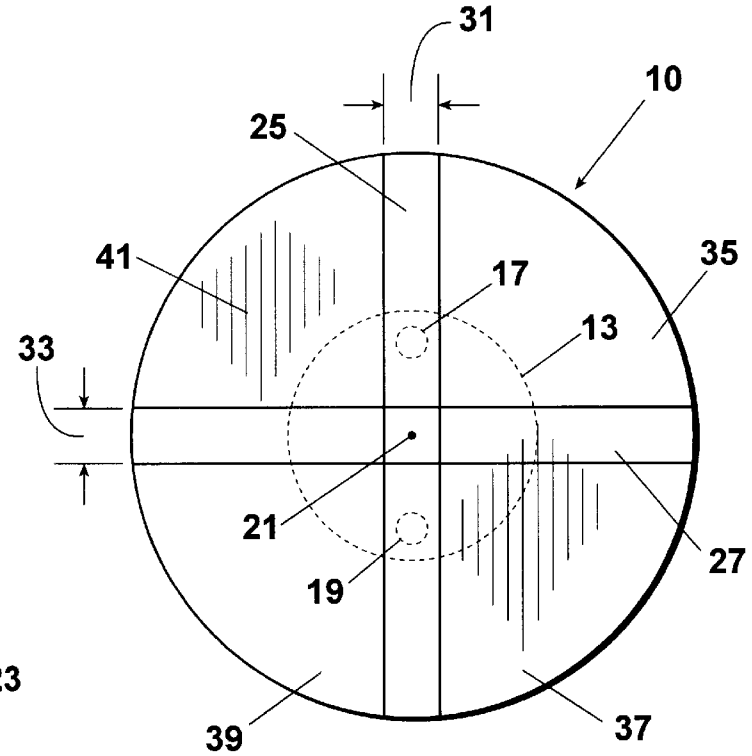
FIG. 3 is a top plan view of the calibration gauge of FIG. 1.
Figure 2:
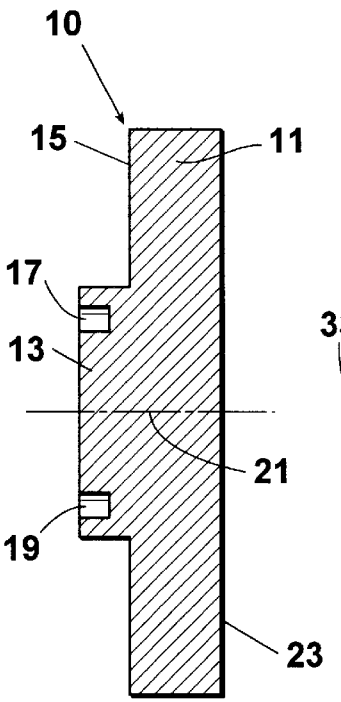
FIG. 2 is a diametric cross-section of the calibration gauge of FIG. 1 taken along the line 2—2.
Figure 1:
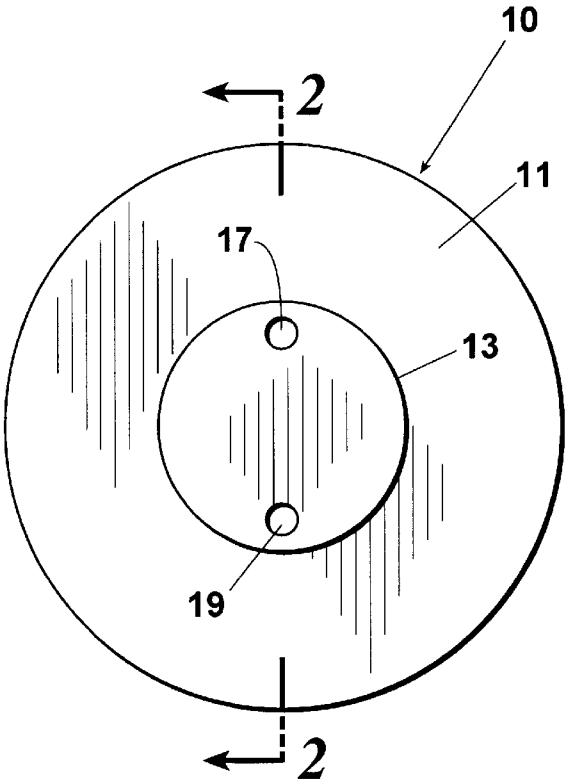
FIG. 1 is a bottom plan view of a preferred embodiment of the calibration gauge of the present invention.

Turning to FIGS. 1–3, the calibrating gauge 10 consists of a disk 11 of material suitable to be cut/ground by the lens cutting/grinding machine. A concentric post 13 extends from one face 15 of the disk 11 as a means for chucking the disk 11 to the machine lens spindle. The post 13 is provided with a pair of prong holes 17 and 19 which serve as a means for maintaining the disk 11 in one of two 180 degree displaced orientations with respect to the X and/or Y axes. Preferably, the prong holes 17 and 19 are symmetrically displaced from the center 21 of the disk 11 and cooperate with a pair of complementarily positioned prongs (not shown) on the machine lens spindle chuck (not shown). Thus, the gauge 10 can be chucked to the machine only in an orientation in which the diameter of the disk 10 on which the prong holes 17 and 19 are aligned is in a known orientation in relation to the X and/or Y axes. A target is delineated on the face 23 of the disk 11 opposite the post 13. The target consists of a pair of bands 25 and 27 aligned along the X and Y axes, respectively. Preferably, and as shown, the X-axis band 25 will be centered on the diameter on which the prong holes 17 and 19 are aligned. The widths 31 and 33 of the bands 25 and 27 are selected so as to be not greater than the permissible error in the calibration of the machine without adjustment. They divide the target face 23 of the disk 11 into four quadrants 35, 37, 39 and 41 and the center of the intersection of the bands 25 and 27 is aligned on the disk center 21 which, when the gauge 10 is chucked to the machine, is aligned on the Z axis.

Figure 5:
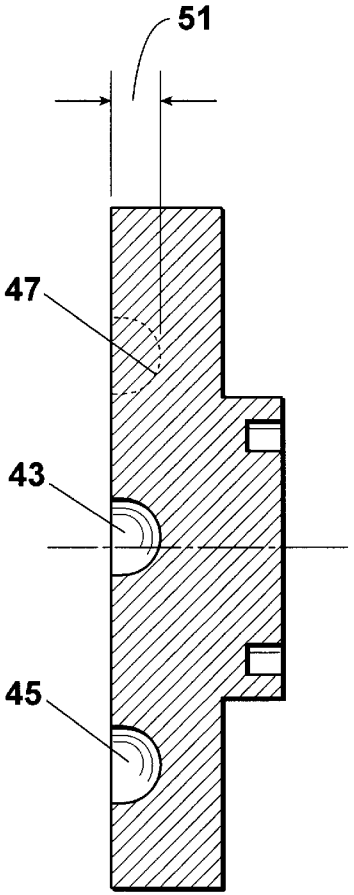
FIG. 5 is a side elevation view of a cut/ground gauge illustrating the method of FIG. 4.
Figure 6:
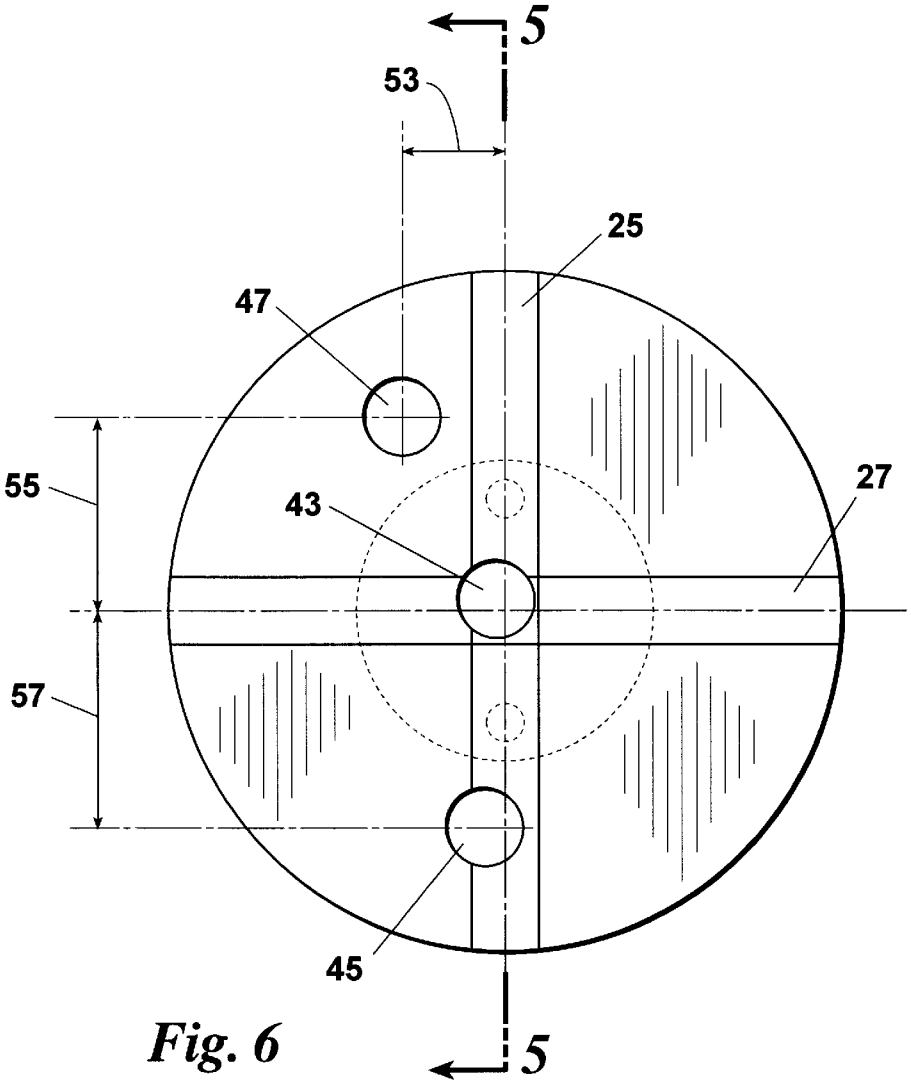
FIG. 6 is a top plan view of the cut/ground gauge of FIG. 5.

Turning to FIGS. 4–6, the method 100 of the present invention can be understood. In practicing the method 100, the calibrating operator begins by setting the first spindle selected cutting/grinding depth 101 for a typical but arbitrary depth to which a lens might be cut/ground. The operator then chucks the calibration gauge to the first spindle 102 and aligns the tool X-axis with the first spindle Z-axis 103 under the control of the computer. The operator then initiates second spindle rotation 104, raises the first spindle to plunge cut/grind the calibration gauge 105 to the preselected depth, terminates the second spindle rotation 106 and dechucks the calibration gauge from the first spindle 107. The operator next measures the cut/grind depth 51 in the gauge 108 and determines the difference between the selected and measured depth 109. The position of the first spindle on the Z-axis is then jockeyed by varying the computer parameters to compensate for the determined difference 110. The operator also observes the quadrant displacement between cut/grind and gauge centers 111. If the cut/grind 43 falls within the intersection of the bands 25 and 27, no further calibration is necessary. If the cut/grind 45 falls within the X-band 25 or the Y-band 27, then adjustment 57 will be necessary only with respect to one of those axes. If the cut/grind 47 falls in one of the quadrants 35, 37, 39 or 41, then adjustments 53 and 55 will have to be made for both X and Z-axes. The operator jockeys the second spindle X and Y-axes to compensate for the observed displacement 112. In the case of X-axis displacement, jockeying is done by varying the computer parameters to compensate for the difference. In the case of Y-axis displacement, the Y-axis calibration of the tool is manually adjusted to compensate for the displacement.

Thus, it is apparent that there has been provided, in accordance with the invention, a gauge and method of using the gauge that fully satisfies the objects, aims and advantages set forth above. While the invention has been described in conjunction with a specific embodiment and method, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use in calibrating a lens cutting/grinding machine in which a lens is mounted on a first spindle for rotational and reciprocal motion about and on a Z-axis and a cutting/grinding tool is mounted on a second spindle for rotational motion about an axis disposed at an obtuse angle in relation to the Z-axis and for reciprocal motion along an X-axis, the alignment of the tool being adjustable along a Y-axis, a calibration gauge comprising:

a disk of material cuttable/grindable by the tool;

means on one face of said disk for chucking said disk to the first spindle for rotation about the Z-axis;

means on said chucking means for maintaining said disc in one of two 180 degree orientations in relation to the X and Y axes; and a target on an opposite face of said disk, said target comprising bands delineated on said disk aligned on the X and Y axes and intersecting at a center of said disk on the Z-axis so as to define four quadrants on said opposite face of said disk.

2. A gauge according to claim 1, said chucking means comprising a concentric post on said one face.

3. A gauge according to claim 2, said maintaining means comprising a pair of prong holes in said post aligned on a diameter thereof for receiving prongs complimentarily positioned on a chuck of the machine.

4. A gauge according to claim 3, said prong holes being symmetrically displaced from a center of said post.

5. A gauge according to claim 3, said diameter being centered on one of said bands.

6. A gauge according to claim 3, said bands being of width not greater than an acceptable error in positioning of the X and Y axes.

7. A method of calibrating a lens cutting/grinding machine in which a lens is mounted on a first spindle for rotational and reciprocal motion about and on a Z-axis and a cutting/grinding tool is mounted on a second spindle for rotational motion about an axis disposed at an obtuse angle in relation to the Z-axis and for reciprocal motion along an X-axis, the positioning of the lens on the Z axis and the positioning of the tool on the X axis being computer controlled and the alignment of the tool being manually adjustable along a Y-axis, comprising the steps of:

setting a limit of Z-axis motion of the first spindle corresponding to a selected depth of cutting/grinding;

chucking a disk-shaped calibration gauge having four quadrants delineated on a working face thereof by bands aligned on the X and Y axes on the first spindle with a center of the disk aligned on the Z-axis of the first spindle;

aligning the X-axis position of the tool with the Z-axis;

initiating rotation of the second spindle;

raising the first spindle to plunge cut/grind the gauge to the selected depth;

lowering the first spindle to enable dechucking of the gauge;

terminating rotation of the second spindle;

dechucking the gauge;

measuring the depth of the cut/grind in the gauge;

determining the difference between the measured depth and the selected depth; and jockeying the Z-axis calibration of the first spindle by varying the computer parameters to compensate for the difference.

8. A method according to claim 7 further comprising the steps of:

observing the quadrant position of the cut/grind center on the gauge to determine the X-axis displacement from center; and jockeying the X-axis calibration of the tool by varying the computer parameters to compensate for the displacement.

9. A method according to claim 7 further comprising the steps of:

observing the quadrant position of the cut/grind center on the gauge to determine the Y-axis displacement from center; and jockeying the Y-axis calibration of the tool manually to compensate for the displacement.

* * * * *